US009229373B1

(12) United States Patent
Gyotoku

(10) Patent No.: US 9,229,373 B1
(45) Date of Patent: Jan. 5, 2016

(54) DEVELOPING DEVICE INCLUDING A DEVELOPER FEEDING MEMBER HAVING A ROTARY SHAFT, A FIRST TRANSPORT BLADE FOR STIRRING AND TRANSPORTING DEVELOPER, A BLOCKING PORTION FOR BLOCKING THE DEVELOPER, A PADDLE EXTENDING PARALLEL TO THE ROTARY SHAFT, AND A SECOND TRANSPORT BLADE FOR TRANSPORTING THE DEVELOPER IN THE OPPOSITE DIRECTION TO THE FIRST TRANSPORT BLADE, AND IMAGE FORMING APPARATUS THEREWITH

(71) Applicant: KYOCERA Document Solutions Inc., Osaka (JP)

(72) Inventor: Eiji Gyotoku, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/733,818

(22) Filed: Jun. 8, 2015

(30) Foreign Application Priority Data

Jul. 17, 2014 (JP) ..... 2014-146661

(51) Int. Cl.
*G03G 15/08* (2006.01)

(52) U.S. Cl.
CPC ..... *G03G 15/0891* (2013.01); *G03G 15/0822* (2013.01); *G03G 15/0839* (2013.01)

(58) Field of Classification Search
CPC ..... G03G 15/0822; G03G 15/0839
USPC ..... 399/254
See application file for complete search history.

(56) References Cited

U.S. PATENT DOCUMENTS

2007/0127951 A1* 6/2007 Ishikawa et al. ... G03G 15/0808 399/254
2008/0145105 A1* 6/2008 Iwamura ..... 399/254
2008/0145109 A1* 6/2008 Murayama et al. G03G 15/0877 399/260
2008/0199222 A1* 8/2008 Nakajima ..... 399/254
2009/0092419 A1* 4/2009 Iwata et al. ..... 399/254
2009/0245879 A1* 10/2009 Minami et al. ..... 399/255
2011/0150537 A1* 6/2011 Watanabe et al. .. G03G 15/0839 399/256
2011/0286768 A1* 11/2011 Muto et al. ..... 399/254
2015/0078787 A1* 3/2015 Gyotoku ..... 399/254

FOREIGN PATENT DOCUMENTS

JP 6-3961 A 1/1994

* cited by examiner

*Primary Examiner* — Billy Lactaoen
*Assistant Examiner* — Arlene Heredia Ocasio
(74) *Attorney, Agent, or Firm* — Stein IP, LLC

(57) ABSTRACT

A developing device includes first and second stirring/transporting members, a developer feeding member, and a developer container that accommodates those components. The first and second stirring/transporting members stir and transport developer. The developer feeding member feeds developer to the first stirring/transporting member. In the developer container, a feeding port through which developer is fed from the developer feeding member to the first stirring/transporting member is formed. The developer feeding member includes a rotary shaft, a first transport blade which stirs and transports developer, a blocking portion which protrudes substantially perpendicularly to the rotary shaft and blocks the developer transported by the first transport blade in a first direction, and a paddle which feeds the developer from a developer supply passage to a first transport chamber.

5 Claims, 5 Drawing Sheets

DEVELOPING DEVICE INCLUDING A DEVELOPER FEEDING MEMBER HAVING A ROTARY SHAFT, A FIRST TRANSPORT BLADE FOR STIRRING AND TRANSPORTING DEVELOPER, A BLOCKING PORTION FOR BLOCKING THE DEVELOPER, A PADDLE EXTENDING PARALLEL TO THE ROTARY SHAFT, AND A SECOND TRANSPORT BLADE FOR TRANSPORTING THE DEVELOPER IN THE OPPOSITE DIRECTION TO THE FIRST TRANSPORT BLADE, AND IMAGE FORMING APPARATUS THEREWITH

INCORPORATION BY REFERENCE

This application is based upon and claims the benefit of priority from the corresponding Japanese Patent Application No. 2014-146661 filed on Jul. 17, 2014, the entire contents of which are incorporated herein by reference.

BACKGROUND

The present disclosure relates to a developing device and to an image forming apparatus incorporating the developing device. More particularly, the present disclosure relates to a developing device including first and second stirring/transporting members which stir and transport developer inside a developer container and a developer feeding member which feeds the developer to the first stirring/transporting member, and to an image forming apparatus incorporating such a developing device.

In an image forming apparatus, an electrostatic latent image formed on an image carrier which comprises a photosensitive member or the like is made visible by being developed into a toner image by a developing device. The developing device stores developer containing toner inside a developer container, and is provided with a developer roller, which feeds the developer to the image carrier, and a stirring/transporting member, which transports, while stirring, the developer inside the developer container to feed it to the developer roller.

In the developing device, toner is consumed through developing operation. For compensatory supply of consumed toner, a conventionally proposed developing device is provided with, in a developer container, a developer feeding member for feeding developer to a stirring/transporting member.

Such a developing device includes, for example, first and second stirring/transporting members which stir and transport developer, a developer feeding member which feeds the developer to the first stirring/transporting member, and a developer container that accommodates the first and second stirring/transporting members and the developer feeding member. In the developer container, a feeding port through which developer is fed from the developer feeding member to the first stirring/transporting member is formed. As the developer feeding member rotates, through the feeding port, the developer is fed from the developer feeding member to the first stirring/transporting member.

SUMMARY

According to one aspect of the present disclosure, a developing device is provided with a developer container, a first stirring/transporting member, a second stirring/transporting member, and a developer feeding member. The developer container is divided into a developer supply passage, a first transport chamber, and a second transport chamber arranged substantially parallel to one another, and stores developer which contains toner. The first stirring/transporting member is arranged in the first transport chamber, and stirs and transports the developer. The second stirring/transporting member is arranged in the second transport chamber, and stirs and transports the developer in the opposite direction to the first stirring/transporting member. The developer feeding member is arranged in the developer supply passage, stirs and transports the developer parallel to the first stirring/transporting member, and feeds the developer to the first transport chamber. A feeding port through which the developer is fed from the developer supply passage to the first transport chamber is formed between the developer supply passage and the first transport chamber. The developer feeding member has a rotary shaft, a first transport blade which is formed on a circumferential surface of the rotary shaft and which stirs and transports the developer in a first direction parallel to the rotary shaft, a blocking portion which is formed on a part of the circumferential surface of the rotary shaft facing about a central part of the feeding port so as to protrude substantially perpendicularly to the rotary shaft and which blocks the developer transported by the first blade in the first direction, and a paddle which is formed on a part of the circumferential surface of the rotary shaft facing the feeding port so as to extend parallel to the rotary shaft and which feeds the developer from the developer supply passage to the first transport chamber.

Further features and advantages of the present disclosure will become apparent from the description of embodiments given below.

DETAILED DESCRIPTION

Figure 1:
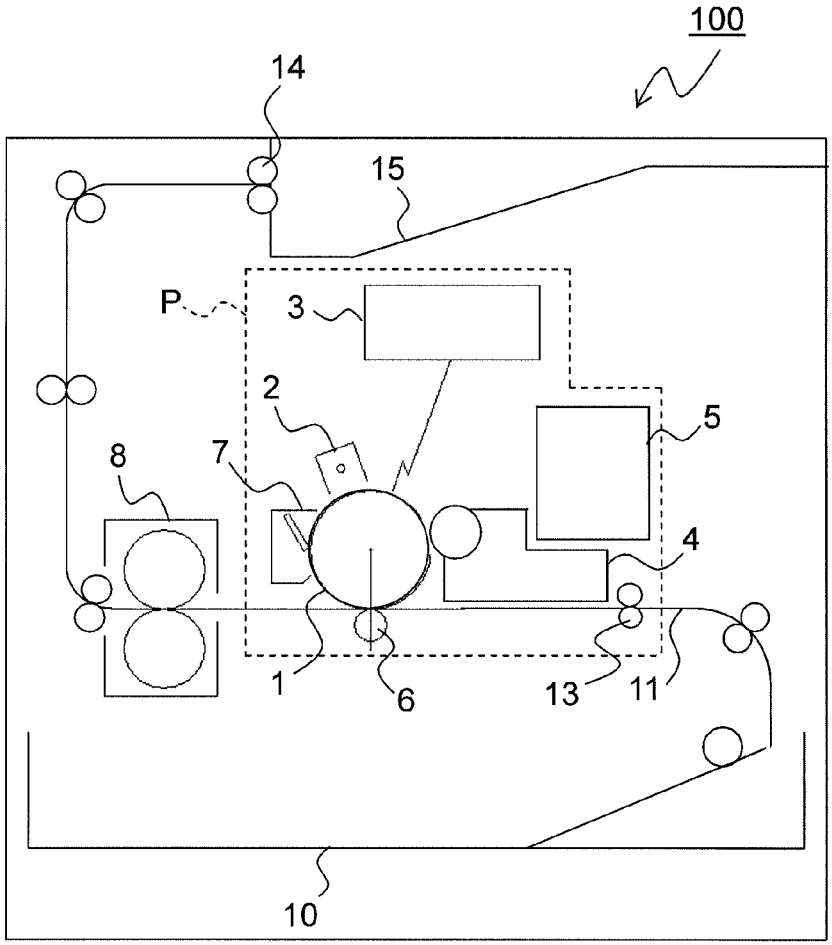
FIG. 1 is a sectional view showing an overall construction of an image forming apparatus provided with a developing device according to one embodiment of the present disclosure.

Hereinafter, embodiments of the present disclosure will be described with reference to the accompanying drawings.

With reference to FIGS. 1 to 7, the construction of an image forming apparatus 100 provided with a developing device 4 according to one embodiment of the present disclosure will be described. In the image forming apparatus (for example, a monochrome printer) 100, when an image forming operation is performed, in an image forming section P inside the apparatus main body, an electrostatic latent image is formed based on document image data transmitted from an unillustrated personal computer (PC), and toner is attached to the electrostatic latent image by the developing device 4 to form a toner image. The toner is fed to the developing device 4 from a toner container 5. In this image forming apparatus 100, an image forming process is performed with respect to the photosensitive drum 1 while the photosensitive drum 1 is rotated in a clockwise direction in FIG. 1.

In the image forming section P, there are arranged, along the rotation direction (the clockwise direction) of the photosensitive drum 1, a charging portion 2, an exposure unit 3, the developing device 4, a transfer roller 6, a cleaning device 7, and a static eliminator (unillustrated). The photosensitive drum 1 is, for example, an aluminum drum laid with a photosensitive layer, and its surface is electrostatically charged by the charging portion 2. On the surface, when it receives a laser beam from the exposure unit 3, which will be described later, an electrostatic latent image with attenuated electric charge is formed. There is no particular restriction on the photosensitive layer, which preferably is, for example, a layer of amorphous silicon (a-Si), which excels in durability, or an organic photosensitive layer (OPC), which generates little ozone when electrostatically charged and which produces a high-resolution image, or the like.

The charging portion 2 serves to electrostatically charge the surface of the photosensitive drum 1 uniformly. For example, as the charging portion 2, a corona discharging device which achieves electrical discharge by application of a high voltage to a thin piece of wire or the like as an electrode is used. In place of the corona discharging device, a contact-type charging device which applies a voltage while keeping the surface of a photosensitive member in contact with a charging member as exemplified by a charging roller can be used. The exposure unit 3 forms an electrostatic latent image on the surface of the photosensitive drum 1 by irradiating the photosensitive drum 1 with a light beam (for example, a laser beam) based on the image data.

The developing device 4 serves to form a toner image by attaching toner to the electrostatic latent image on the photosensitive drum 1. Here, magnetic one-component developer (hereinafter also referred to simply as toner) containing a magnetic toner component alone is contained in the developing device 4. The detailed structure of the developing device 4 will be described later. The transfer roller 6 transfers, without disturbing, the toner image formed on the surface of the photosensitive drum 1 to paper transported through a paper transport passage 11. The cleaning device 7 is provided with a cleaning roller, a cleaning blade, or the like that makes line contact with the photosensitive drum 1 in its longitudinal direction, and after the toner image is transferred to the paper, the cleaning device 7 removes unused toner left behind on the surface of the photosensitive drum 1.

Then, the exposure unit 3 irradiates the photosensitive drum 1 with a laser beam (a ray of light) based on previously entered image data, and thereby forms an electrostatic latent image based on the image data on the surface of the photosensitive drum 1. Thereafter, the developing device 4 attaches toner to the electrostatic latent image, and thereby forms a toner image.

Toward the image forming section P in which the toner image has been formed as described above, paper is transported with predetermined timing from a paper storage portion 10 through the paper transport passage 11 and a registration roller pair 13, so that the toner image on the surface of the photosensitive drum 1 is transferred to the paper by the transfer roller 6 in the image forming section P. Then, the paper to which the toner image has been transferred is separated from the photosensitive drum 1 and is transported to a fusing portion 8, where heat and pressure are applied and thereby the toner image is fused on the paper. The paper which has passed through the fusing portion 8 passes through a discharge roller pair 14 and is discharged onto a paper discharge portion 15.

Figure 2:
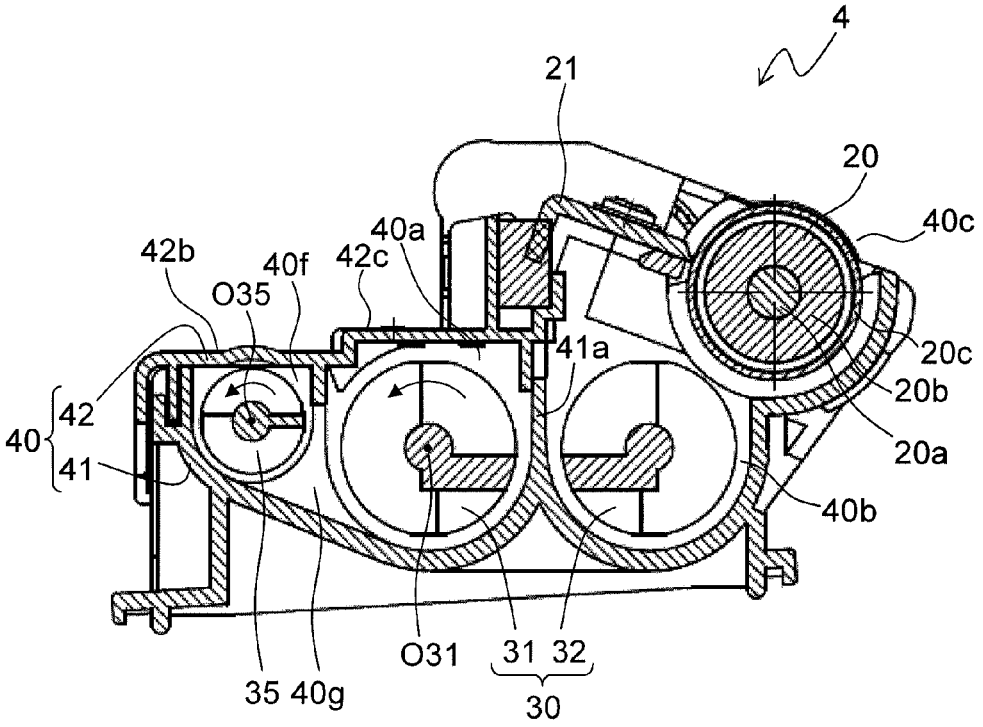
FIG. 2 is a side sectional view showing a structure of a developing device according to one embodiment of the present disclosure.

Now, with reference to FIG. 2, the detailed structure of the developing device 4 will be described. FIG. 2 is a view from behind what is shown in FIG. 1, and accordingly, in FIG. 2, the arrangement of components inside the developing device 4 is reversed left to right as compared with that in FIG. 1.

As shown in FIG. 2, the developing device 4 includes a developing roller (developer carrier) 20, a regulating blade 21, a stirring/transporting member 30, a developer feeding member 35, a developer container 40 that accommodates those components, etc.

The developer container 40 forms the housing of the developing device 4, and has a body portion 41 which is open at its top surface, and a cover member 42 which covers the top surface of the body portion 41. The developer container 40 is divided into a first transport chamber 40*a* and a second transport chamber 40*b* by a partition portion 41*a* formed in the body portion 41. One-component developer containing magnetic toner is stored in the first transport chamber 40*a* and the second transport chamber 40*b*. The developer container 40 rotatably holds the stirring/transporting member 30, the developer feeding member 35, and the developing roller 20. In the developer container 40, an opening 40*c* is formed through which the developing roller 20 is exposed toward the photosensitive drum 1 (see FIG. 1).

The developing roller 20 is arranged opposite the photosensitive drum 1 across a predetermined distance. The developing roller 20 feeds toner to the photosensitive drum 1 in a region of the developing roller 20 opposite and close to the photosensitive drum 1. The stirring/transporting member 30 is arranged obliquely below, to the lower left of, the developing roller 20. The regulating blade 21 is fixedly held on the developer container 40, on the left side of the developing roller 20.

The stirring/transporting member 30 is composed of two spirals, namely a first spiral (first stirring/transporting member) 31 and a second spiral (second stirring/transporting member) 32. The second spiral 32 is arranged obliquely below, to the lower left of, the developing roller 20 inside the second transport chamber 40*b*, and the first spiral 31 is arranged next to, on the left side of, the second spiral 32 inside the first transport chamber 40*a*.

The first and second spirals 31 and 32 transport developer while stirring it. Communication portions (an upstream-side communication portion 40*d* and a downstream-side communication portion 40*e*, which will be described later) are provided in both longitudinal-direction end parts (the direction being the front/rear direction with respect to the plane of FIG. 2) of the partition portion 41*a* which separates the first transport chamber 40*a* and the second transport chamber 40*b*. As the first spiral 31 rotates, developer is transported to the second spiral 32 via one of the communication portions provided in the partition portion 41*a*, and the developer circulates inside the first transport chamber 40*a* and the second transport chamber 40*b*. Then, the developer is fed from the second spiral 32 to the developing roller 20.

The developing roller 20 is composed of a fixed shaft 20*a*, a magnetic pole member 20*b*, a developing sleeve 20*c* formed of a non-magnetic metal material in a cylindrical shape, etc. The developing roller 20 is rotated in the clockwise direction in FIG. 2 by a driving mechanism comprising a motor and gears, of which none is illustrated.

As the developing sleeve 20*c* to which a developing bias is applied rotates, in a developing region (a region where the developing roller 20 faces the photosensitive drum 1), due to the potential difference between the developing bias and the exposed part of the photosensitive drum 1, toner carried on a surface of the developing sleeve 20*c* flies to the photosensitive drum 1. The flying toner attaches, sequentially, to the exposed part on the photosensitive drum 1 in rotation, and thus the electrostatic latent image on the photosensitive drum 1 is developed.

Now, a stirring portion in the developing device 4 will be described in detail.

Figure 3:
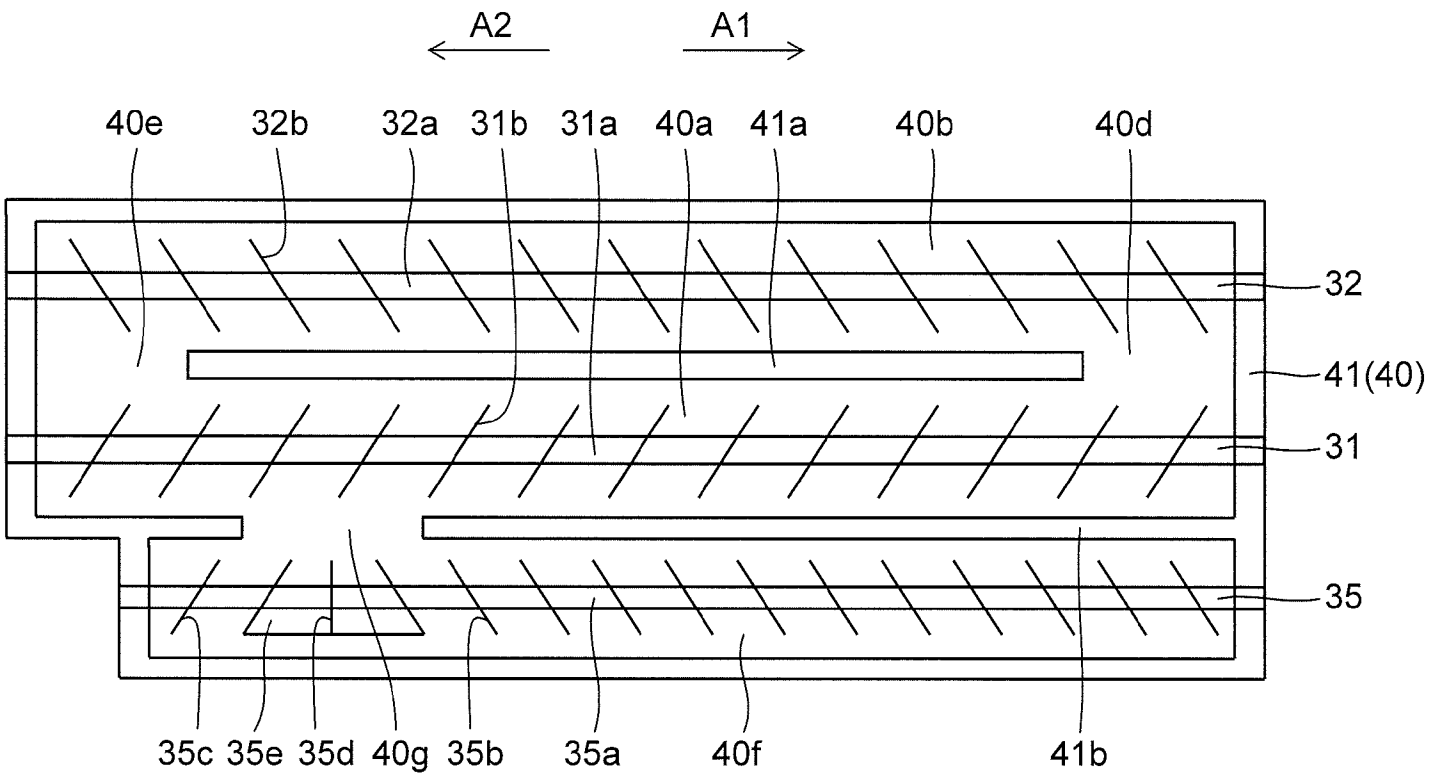
FIG. 3 is a plan sectional view showing a structure of a stirring portion in a developing device according to one embodiment of the present disclosure.
Figure 4:
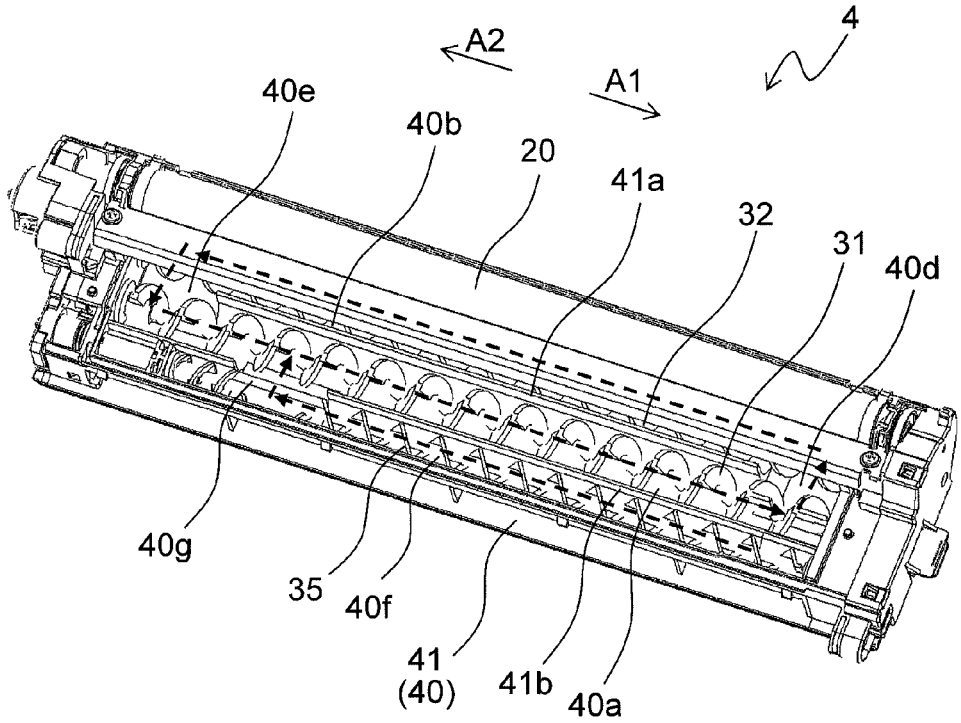
FIG. 4 is a perspective view of a developing device, in a state with a cover member removed, according to one embodiment of the present disclosure.

As shown in FIGS. 3 and 4 and described above, in the developer container 40, there are formed a partition portion 41*a*, a first transport chamber 40*a*, a second transport chamber 40*b*, an upstream-side communication portion 40*d*, and a downstream-side communication portion 40*e*, and there is further formed a developer supply passage 40*f*. The developer supply passage 40*f* is a passage through which new developer is supplied from the toner container 5 to the first transport chamber 40*a*.

The first transport chamber 40*a*, the second transport chamber 40*b*, and the developer supply passage 40*f* are arranged parallel to each other. The partition portion 41*a* which extends in the longitudinal direction of the developer container 40 is provided so as to separate the first transport chamber 40*a* and the second transport chamber 40*b*, and the partition portion 41*b* which extends in the longitudinal direction of the developer container 40 is provided so as to separate the developer supply passage 40*f* and the first transport chamber 40*a*. With respect to the first transport chamber 40*a*, the left side in FIG. 3 is the upstream side and the right side in FIG. 3 is the downstream side; with respect to the second transport chamber 40*b*, the right side in FIG. 3 is the upstream side and the left side in FIG. 3 is the downstream side. Thus, the communication portions are distinguished between the upstream-side and downstream-side ones relative to the second transport chamber 40*b*.

The upstream-side communication portion 40*d* and the downstream-side communication portion 40*e* are formed, respectively, on one and the other sides (A1- and A2-direction sides) in the longitudinal direction of the partition portion 41*a*. Through the upstream-side communication portion 40*d*, the end parts in the A1 direction (second direction) of the first transport chamber 40*a* and the second transport chamber 40*b* communicate with each other. Through the downstream-side communication portion 40*e*, the end parts in the A2 direction (first direction) of the first transport chamber 40*a* and the second transport chamber 40*b* communicate with each other. Thus, developer can circulate inside the first transport chamber 40*a*, the upstream-side communication portion 40*d*, the second transport chamber 40*b*, and the downstream-side communication portion 40*e*.

Figure 5:
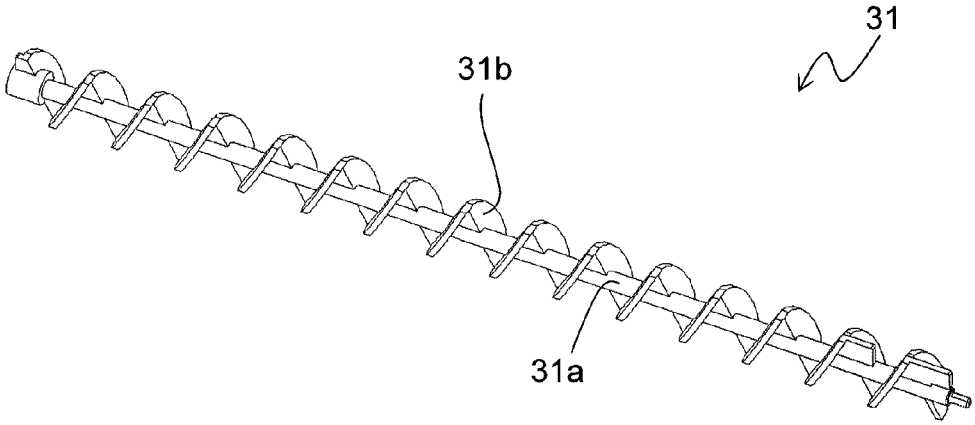
FIG. 5 is a perspective view showing a structure of a first spiral in a developing device according to one embodiment of the present disclosure.

As shown in FIGS. 3 and 5, the first spiral 31 has a rotary shaft 31*a* and a first helical blade 31*b* provided integrally with the rotary shaft 31*a* and formed in a helical shape with a predetermined pitch in the axial direction of the rotary shaft 31*a*. The rotary shaft 31*a* is rotatably supported on the developer container 40. The first helical blade 31*b* transports, while stirring, the developer inside the first transport chamber 40*a* in the A1 direction.

As shown in FIG. 3, the second spiral 32 has a rotary shaft 32*a* and a second helical blade 32*b* provided integrally with the rotary shaft 32*a* and formed in a helical shape with the same pitch as the first helical blade 31*b* in the axial direction of the rotary shaft 32*a* but with a blade winding in the opposite direction (in the opposite phase). The rotary shaft 32*a* is arranged parallel to the rotary shaft 31*a* and is rotatably supported on the developer container 40. The second helical blade 32*b* transports, while stirring, the developer inside the second transport chamber 40*b* in the A2 direction (in the direction opposite to the A1 direction) so as to feed the developer to the developing roller 20.

Figure 6:
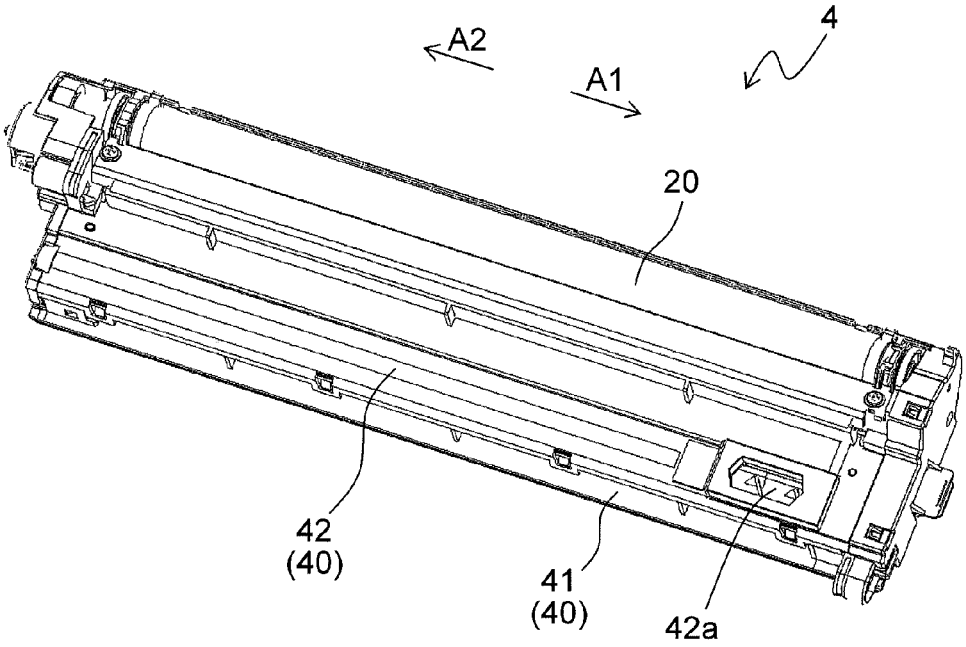
FIG. 6 is a perspective view showing a structure of a developing device according to one embodiment of the present disclosure.
Figure 7:
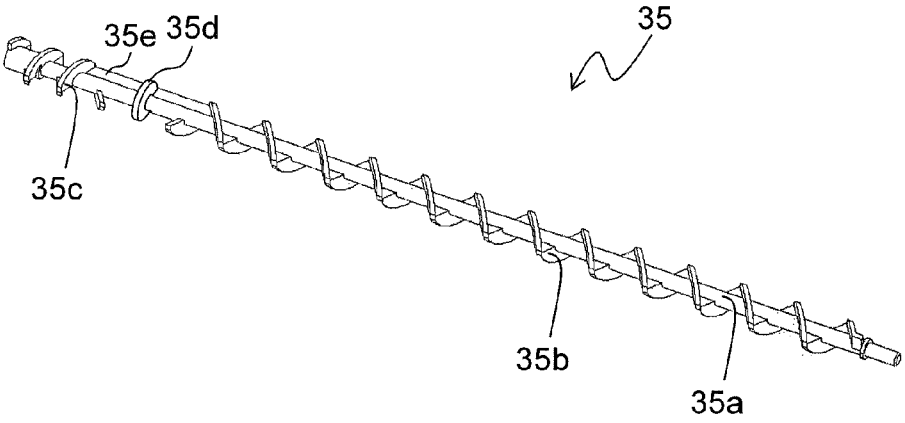
FIG. 7 is a perspective view showing a structure of a developer feeding member in a developing device according to one embodiment of the present disclosure.

As shown in FIG. 6, in an A1-direction part of the developer supply passage 40*f*, a supply port 42*a* through which new developer is supplied from the toner container 5 provided over the developer container 40 into the developer container 40 is formed in the cover member 42. To the supply port 42*a*, according to the detection result of a toner sensor (unillustrated) which detects the amount of the developer inside the developer container 40, the toner (developer) stored in the toner container 5 (see FIG. 1) is supplied. As shown in FIG. 3, in an A2-direction part of the developer supply passage 40*f*, a feeding port 40*g* through which the developer is fed from the developer supply passage 40*f* to the first transport chamber 40*a* is formed. Thus, the developer supply passage 40*f* is a passage through which the developer fed to an A1-direction part is transported in the A2 direction so as to be fed to the upstream side of the first transport chamber 40*a*.

Inside the developer supply passage 40*f*, the developer feeding member 35 is arranged parallel to the first spiral 31 and the second spiral 32. A shown in FIGS. 3 and 7, the developer feeding member 35 has a rotary shaft 35*a*, and a third helical blade (a first transport blade) 35*b* and a fourth helical blade (a second transport blade) 35*c*, which are provided integrally with the rotary shaft 35*a*. The third helical blade 35*b* is formed in a helical shape with a blade winding in the opposite direction (in the opposite phase) to the first helical blade 31*b* in the axial direction of the rotary shaft 35*a*, and is formed from the supply port 42*a* (see FIG. 6) to the feeding port 40*g*. The fourth helical blade 35*c* is formed in a helical shape with a blade winding in the opposite direction (in the opposite phase) to the third helical blade 35*b*, and is formed from the feeding port 40*g* to an A2-direction end part.

In a part of the circumferential surface of the rotary shaft 35*a* facing the supply port 40*g*, a blocking portion 35*d* and a paddle 35*e* are provided integrally with the rotary shaft 35*a*. The blocking portion 35*d* is formed on a part of the circumferential surface of the rotary shaft 35*a* facing a vicinity of a central part of the feeding port 40*g* in the A1-A2 direction so as to protrude substantially vertically toward the rotary shaft 35*a*. The blocking portion 35*d* blocks the developer transported by the third helical blade 35*b* in the A2 direction.

The paddle 35*e* is formed on a part of the circumferential surface of the rotary shaft 35*a* facing the feeding port 40*g* so as to abut both sides (the third helical blade 35*b* side and the fourth helical blade 35*c* side) of the blocking portion 35*d*. The paddle 35*e* is formed so as to extend substantially parallel to the rotary shaft 35*a*, and feeds the developer from the developer supply passage 40*f* to the first transport chamber 40*a*.

The blocking portion 35*d*, the paddle 35*e*, the third helical blade 35*b*, and the fourth helical blade 35*c* are formed such that their rotation orbits have the substantially same radius.

As shown in FIG. 2, a part of the cover member 42 forming a top surface 42*b* of the developer supply passage 40*f* is arranged at substantially the same height as a top surface 42*c* of the first transport chamber 40*a*. Right over the top surfaces 42*b* and 42*c*, the toner container 5 is arranged.

The center O35 of the rotary shaft 35*a* of the developer feeding member 35 is arranged at a higher position than the center O31 of the rotary shaft 31*a* of the first spiral 31.

The developer feeding member 35 is configured to rotate in the same direction (in the counter-clockwise direction in FIG. 2) as the first spiral 31, so that the developer fed to the supply port 42*a* is transported toward the feeding port 40*g*. The developer is blocked from moving in the A2 direction by the blocking portion 35*d* and is transported via the feeding port 40*g* to the first transport chamber 40*a* by the paddle 35*e*.

The developer feeding member 35, the first spiral 31, and the second spiral 32 are driven to rotate individually by a driving mechanism comprising a motor and gears, of which none is illustrated.

In this embodiment, as described above, the developer feeding member 35 includes the rotary shaft 35*a*, the third helical blade 35*b* which stirs and transports the developer in the A2 direction, the blocking portion 35*d* which faces a vicinity of a central part of the feeding port 40*g* and which blocks the developer transported by the third helical blade 35*b* in the A2 direction, and the paddle 35*e* which faces the feeding port 40*g* and which feeds the developer through the developer supply passage 40*f* to the first transport chamber 40*a*. Thus, the developer that has been transported by the third helical blade 35*b* in the A2 direction can be, while being blocked by the blocking portion 35*d*, fed by the paddle 35*e* through the developer supply passage 40*f* to the first transport chamber 40*a*, and this makes smooth passage of the developer through the feeding port 40*g* possible. This helps suppress stagnation of the developer in the feeding port 40*g*, and thereby it is possible to prevent the developer from irregularly breaking in the feeding port 40*g* and being fed toward the first spiral 31. This helps prevent a mass of developer from being fed jerkily to the first spiral 31 and the second spiral 32. It is thus possible to prevent toner from being electrostatically charged differently from part to part, and thus to suppress production of a foggy image.

As described above, the center O35 of the rotary shaft 35*a* of the developer feeding member 35 is arranged at a higher position than the center O31 of the rotary shaft 31*a* of the first spiral 31. Since this makes smooth passage of the developer through the feeding port 40*g* possible, it is possible to suppress stagnation of the developer in the feeding port 40*g* more effectively.

As described above, a part of the developer container 40 forming the top surface 42*b* of the developer supply passage 40*f* is arranged at substantially the same height as the top surface 42*c* of the first transport chamber 40*a*. Thus, when the toner container 5 is arranged over the developer supply passage 40*f* and the first transport chamber 40*a*, it is possible to reduce waste space formed between, at one end, the bottom surface of the toner container 5 and, at the other end, the developer supply passage 40*f* and the first transport chamber 40*a*. When the top surface 42*b* is arranged at substantially the same height as the top surface 42*c*, it is difficult to arrange the developer feeding member 35 at a sufficiently high position with respect to the first spiral 31. Thus, in that case, it is particularly effective to provide the developer feeding member 35 with the blocking portion 35*d* and the paddle 35*e* so as to achieve smooth passage of the developer through the feeding port 40*g*.

As described above, the blocking portion 35*d* and the paddle 35*e* are formed such that their rotation orbits have the substantially same radius. Thus, it is possible to form both the blocking portion 35*d* and the paddle 35*e* in the maximum size that can be arranged in the developer supply passage 40*f* in the radical direction.

As described above, since the developer supply passage 40*f* is formed so as to extend beyond the feeding port 40*g* in the A2 direction, when there is a larger amount of developer locally somewhere in the first transport chamber 40*a* and the second transport chamber 40*b*, a part of the developer flows into a part of the developer supply passage 40*f* beyond the blocking portion 35*d* in the A2 direction. Then, the developer which has flowed there is returned into the first transport chamber 40*a* by the fourth helical blade 35*c* and the paddle 35*e*. In this way, it is possible to keep the amount of developer uniform in the first transport chamber 40*a* and the second transport chamber 40*b*.

Now, a confirmatory experiment performed to confirm an effect of the above-described embodiment will be described.

The confirmatory experiment was performed on a practical example that corresponds to the above-described embodiment and on a comparative example that does not correspond to the above-described embodiment.

In the practical example, the developing device 4 according to the above-described embodiment was used. Specifically, the developer feeding member 35 including the rotary shaft 35*a* provided with the third helical blade 35*b*, the fourth helical blade 35*c*, the blocking portion 35*d*, and the paddle 35*e* was used.

The first and second spirals 31 and 32 had helical blades with a diameter of 20 mm, and were rotated at a rotation rate of 34 rpm. The developer feeding member 35 had a helical blade with a diameter of 8 mm, and was rotated at a rotation rate of 50 rpm. The photosensitive drum 1 had a linear velocity of 106 mm/sec, and the developing roller 20 had a linear velocity of 150 mm/sec. The developing roller 20 had a diameter of 20 mm, and was rotated at a rotation rate of 95 rpm. The voltage applied to the developing roller 20 had a Vpp of 1600 V, a duty factor of 45%, a frequency of 2.7 kHz, and a Vdc (DC component) of 290 V. The developer (toner) used had an average particle diameter of 8.0 μm.

In the comparative example, in contrast to the practical example, a developer feeding member which was not provided with a blocking portion 35*d* was used. Otherwise, the structure of the comparative example was similar to that of the practical example.

In each of the practical and comparative examples, the number of foggy images produced was counted every 1000 printed sheets until 10000 sheets were printed. The experiment was performed by use of paper of A4 size with a printing ratio of 0.1%. Table 1 shows the results with the practical and comparative examples.

TABLE 1

| | SHEETS WITH FOGGY IMAGES | |
|---|---|---|
| NUMBER OF PRINTED SHEETS | PRACTICAL EXAMPLE | COMPARATIVE EXAMPLE |
| 1 to 1000 | 0 | 0 |
| 1001 to 2000 | 0 | 0 |
| 2001 to 3000 | 0 | 8 |
| 3001 to 4000 | 0 | 6 |
| 4001 to 5000 | 0 | 0 |
| 5001 to 6000 | 0 | 16 |
| 6001 to 7000 | 0 | 2 |
| 7001 to 8000 | 0 | 21 |
| 8001 to 9000 | 0 | 11 |
| 9001 to 10000 | 0 | 18 |

As shown in Table 1, in the practical example, no foggy image was produced until 10000 sheets were printed. On the other hand, in the comparative example, foggy images started to be produced after 2000 sheets were printed.

The reason is considered to be as follows. In the comparative example, passage of developer through the feeding port

40*g* was not smooth, and thus developer stagnated in the feeding port 40*g*. Then, the stagnated developer irregularly broke and a mass of it was fed toward the first spiral 31. This resulted in a foggy image because the developer was not sufficiently stirred and dispersed in the developing device. Incidentally, when the printing ratio is low, developer is more likely to deteriorate, and thus foggy images are more likely to be produced. On the other hand, in the practical example, smooth passage of developer through the feeding port 40*g* was achieved and thereby the developer was prevented from stagnating in the feeding port 40*g*. This helped prevent developer from irregularly breaking in the feeding port 40*g* so that no foggy images were produced.

It should be understood that the embodiments disclosed herein are illustrative in all respects and are not restrictive. The scope of the present disclosure is defined not by the description of embodiments given above but by the appended claims, and encompasses many modifications and variations made in the sense and scope equivalent to those of the claims.

For example, the above-described embodiment is applicable, not only to monochrome printers like the one shown in FIG. 1, but to digital and analog monochrome copiers, color printers, color copiers, facsimile machines, etc., that is, various image forming apparatuses provided with a developing device including a first stirring/transporting member, a second stirring/transporting member, and a developer feeding member.

Although the above-described embodiment deals with an example where one-component developer containing toner alone is used as developer, this is in no way meant to limit the present disclosure. Instead, as developer, two-component developer that contains carrier and toner may be used.

What is claimed is:

1. A developing device comprising:

a developer container divided into a developer supply passage, a first transport chamber, and a second transport chamber arranged substantially parallel to one another, the developer container storing developer containing toner;

a first stirring/transporting member arranged in the first transport chamber, the first stirring/transporting member stirring and transporting the developer;

a second stirring/transporting member arranged in the second transport chamber, the second stirring/transporting member stirring and transporting the developer in a direction opposite to a direction in which the first stirring/transporting member stirs and transports the developer;

a developer feeding member arranged in the developer supply passage, the developer feeding member stirring and transporting the developer parallel to the first stirring/transporting member and feeding the developer to the first transport chamber, wherein a feeding port through which the developer is fed from the developer supply passage to the first transport chamber is formed between the developer supply passage and the first transport chamber, the developer supply passage and the developer feeding member are formed so as to extend beyond the feeding port in the first direction, and the developer feeding member has:

a rotary shaft;

a first transport blade formed on a circumferential surface of the rotary shaft, the first transport blade stirring and transporting the developer in a first direction parallel to the rotary shaft;

a blocking portion formed on a part of the circumferential surface of the rotary shaft facing a vicinity of a central part of the feeding port so as to protrude substantially perpendicularly to the rotary shaft, the blocking portion blocking the developer transported by the first transport blade in the first direction;

a paddle formed on a part of the circumferential surface of the rotary shaft facing the feeding port so as to extend parallel to the rotary shaft, the paddle feeding the developer from the developer supply passage to the first transport chamber; and a second transport blade formed on a part of the rotary shaft beyond the blocking portion in the first direction so as to extend from the feeding port to an end part of the developer supply passage in the first direction, the second transport blade transporting the developer in a second direction opposite to the first direction, the first and second transport blades are, in parts thereof facing the supply port, arranged in line symmetry about, as an axis of symmetry, a center of the feeding port, and the paddle extends from the blocking portion both in the first and second directions, and is formed so as to extend to parts of the rotary shaft facing end parts of the feeding port in the first and second directions respectively.

2. The developing device of claim 1, wherein a center of the rotary shaft of the developer feeding member is arranged at a higher position than a center of a rotary shaft of the first stirring/transporting member.

3. The developing device of claim 2, wherein a part of the developer container forming a top surface of the developer supply passage is arranged substantially at a same height as a top surface of the first transport chamber.

4. The developing device of claim 1, wherein the blocking portion and the paddle are formed such that respective rotation orbits thereof have substantially a same radius.

5. An image forming apparatus comprising the developing device of claim 1.

* * * * *